US010399740B2

(12) United States Patent
Karimov et al.

(10) Patent No.: US 10,399,740 B2
(45) Date of Patent: Sep. 3, 2019

(54) TRANSPORT PALLET, MODULE AND FOLDING SHEETS FOR SAME, AND METHOD FOR PRODUCING A TRANSPORT PALLET

(71) Applicant: Karimov GmbH, Hannover (DE)

(72) Inventors: Rustem Karimov, Wilhelmshaven (DE); Eduard Schutz, Wilhelmshaven (DE)

(73) Assignee: KARIMOV GMBH, Hannover (DE)

( * ) Notice: Subject to any disclaimer, the term of this patent is extended or adjusted under 35 U.S.C. 154(b) by 0 days.

(21) Appl. No.: 15/760,926

(22) PCT Filed: Sep. 22, 2016

(86) PCT No.: PCT/EP2016/072602
§ 371 (c)(1),
(2) Date: Mar. 16, 2018

(87) PCT Pub. No.: WO2017/050932
PCT Pub. Date: Mar. 30, 2017

(65) Prior Publication Data

US 2018/0265247 A1 Sep. 20, 2018

(30) Foreign Application Priority Data

Sep. 22, 2015 (DE) ..... 10 2015 012 066

(51) Int. Cl.
*B65D 19/00* (2006.01)

(52) U.S. Cl.
CPC ..... *B65D 19/0016* (2013.01); *B65D 19/0073* (2013.01); *B65D 2519/00019* (2013.01);
(Continued)

(58) Field of Classification Search
CPC ..... B65D 19/0016; B65D 19/0073; B65D 2519/00019; B65D 2519/00054;
(Continued)

(56) References Cited

U.S. PATENT DOCUMENTS 3,216,376 A 11/1965 Anderson et al.
3,434,425 A * 3/1969 Critcher ..... A01K 81/00 102/399

(Continued)

FOREIGN PATENT DOCUMENTS

DE 3922635 A1 1/1991
DE 9110425 U1 10/1991

(Continued)

OTHER PUBLICATIONS

European Office Action based on Application No. 16 778 709.2, dated Mar. 7, 2019.

*Primary Examiner* — Janet M Wilkens
(74) *Attorney, Agent, or Firm* — Muncy, Geissler, Olds & Lowe, P.C.

(57) ABSTRACT

A transport pallet includes a base body, which includes an upper surface, a lower surface and feet. The base body includes a composite which exclusively has multiple modules that are similar to one another and connecting element, whereby the modules are connected to one another. Each module includes a folding sheet and a fixing element and provides a respective segment of the upper surface of the base body. The base body has exactly four modules, where each module has exactly four feet arranged spaced apart from one another, where each of which has foot lateral surfaces around a respective hollow space, and where each side has a respective lateral surface which is formed from the foot lateral surfaces of two respective feet, where the foot lateral surfaces, which form opposing lateral surfaces of
(Continued)

Figure 3:
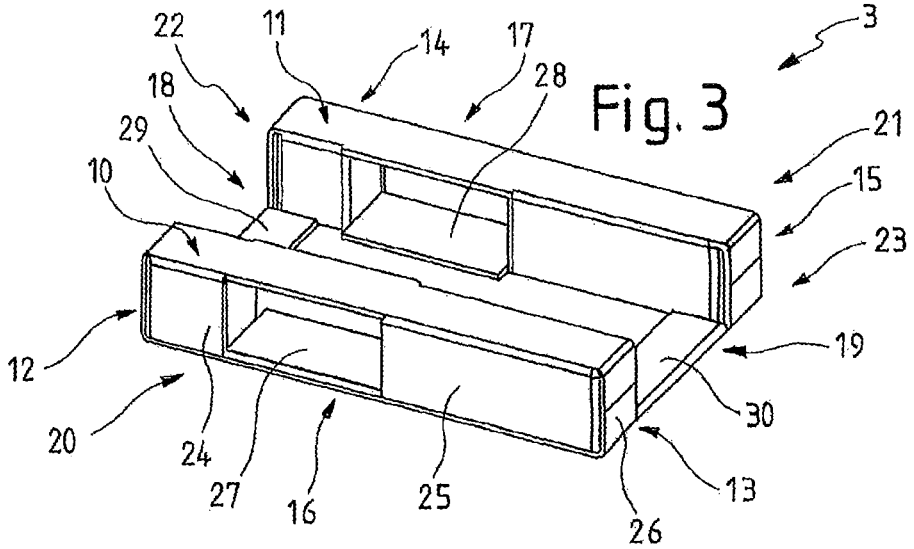

modules connected to one another, rest flat against one another.

11 Claims, 5 Drawing Sheets

(52) U.S. Cl.
CPC ..... *B65D 2519/00054* (2013.01); *B65D 2519/00268* (2013.01); *B65D 2519/00273* (2013.01); *B65D 2519/00288* (2013.01); *B65D 2519/00293* (2013.01); *B65D 2519/00318* (2013.01); *B65D 2519/00323* (2013.01); *B65D 2519/00333* (2013.01); *B65D 2519/00562* (2013.01); *B65D 2519/00756* (2013.01)

(58) Field of Classification Search
CPC ..... B65D 2519/00268; B65D 2519/00273; B65D 2519/00288; B65D 2519/2519; B65D 2519/00293; B65D 2519/00318; B65D 2519/00323; B65D 2519/00333; B65D 2519/00562; B65D 2519/00756
USPC ..... 108/51.3, 51.11; 206/386, 595–600
See application file for complete search history.

(56) References Cited

U.S. PATENT DOCUMENTS 3,464,371 A * 9/1969 Gifford ..... B65D 19/0012 108/51.3
3,520,258 A * 7/1970 Shepherd ..... B65D 19/0012 108/51.3
3,628,469 A 12/1971 Neitzke
3,666,165 A * 5/1972 Osborne ..... B65D 19/0038 108/51.3
3,911,834 A * 10/1975 Quaintance ..... B65D 19/0016 108/51.3
3,986,611 A * 10/1976 Dreher ..... B65D 71/0096 206/597
3,993,191 A 11/1976 Membrino
4,100,859 A * 7/1978 Clark, Jr. ..... B65D 19/0012 108/51.3
4,895,080 A * 1/1990 Thomas ..... B65D 19/38 108/56.1
5,176,090 A * 1/1993 Roberts ..... B65D 19/0026 108/51.3
5,370,062 A * 12/1994 Johnston ..... B65D 19/0026 108/51.3
5,377,600 A * 1/1995 Speese ..... B65D 19/0016 108/51.3
6,076,475 A 6/2000 Kuhn et al.
6,135,030 A * 10/2000 Besaw ..... B65D 19/0012 108/51.3
6,357,364 B1 * 3/2002 Maloney ..... B65D 19/0026 108/51.11
7,516,706 B2 * 4/2009 Creighton ..... B65D 19/0026 108/56.3
7,963,235 B2 * 6/2011 Muirhead ..... B65D 19/0012 108/55.5
8,403,284 B2 * 3/2013 Korbonski ..... B65D 19/0069 248/346.02
2012/0312200 A1 * 12/2012 Monteith ..... B65D 19/0026 108/51.3

FOREIGN PATENT DOCUMENTS

DE 102010049074 A1 4/2012
DE 102011003999 8/2012
EP 0155154 * 9/1985
EP 2065311 A1 6/2009
EP 2196401 A1 6/2016
GB 767206 1/1957
WO WO 9957025 A1 11/1999
WO WO 2017/050932 A1 3/2017

* cited by examiner

Fig. 1
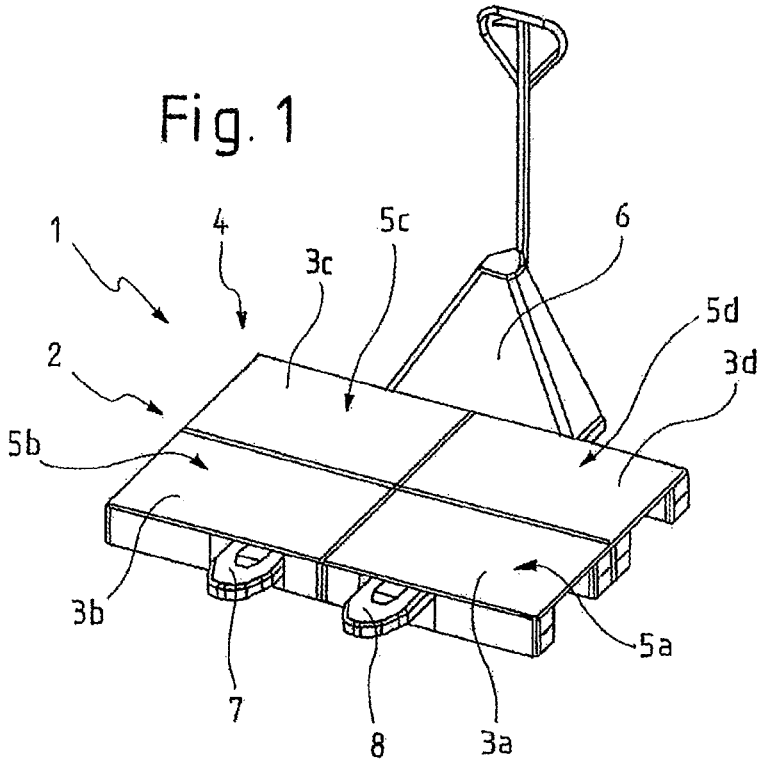
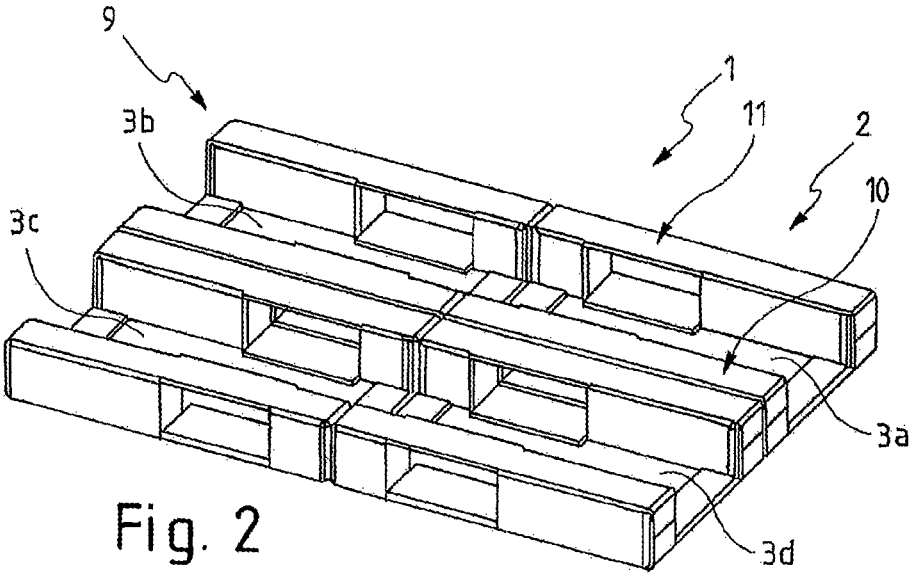
Fig. 2

Fig. 5
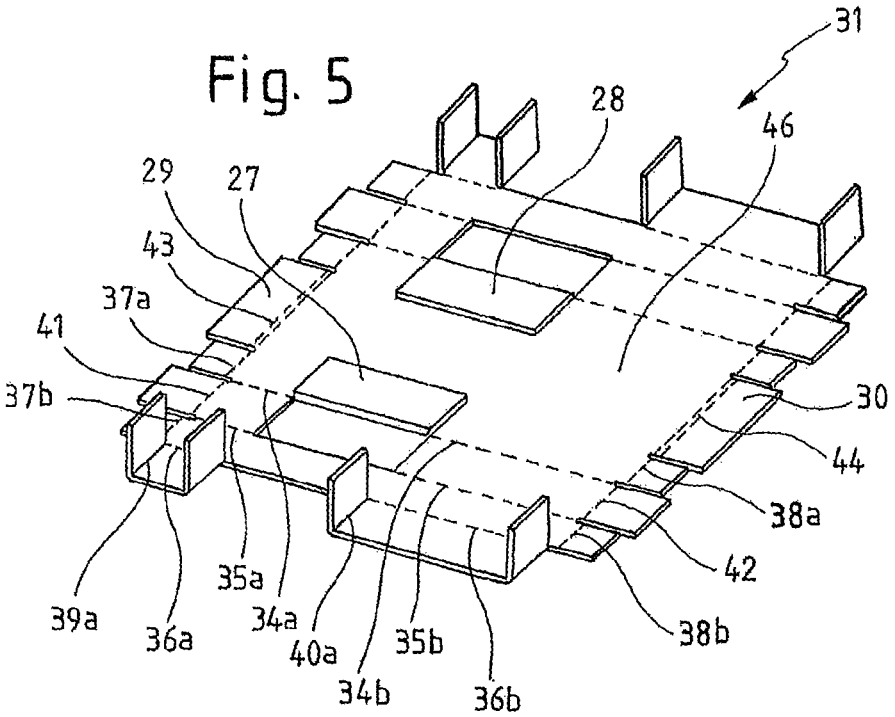
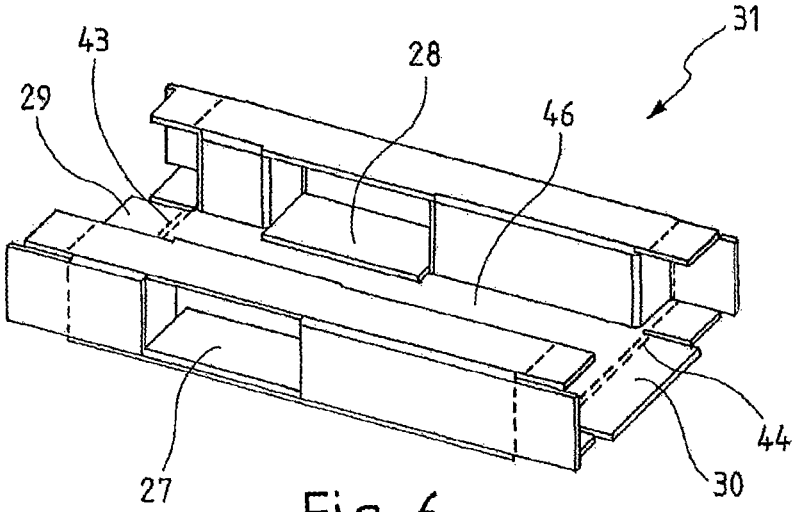
Fig. 6

TRANSPORT PALLET, MODULE AND FOLDING SHEETS FOR SAME, AND METHOD FOR PRODUCING A TRANSPORT PALLET

The invention relates to a transport pallet with a base body. In particular, the transport pallet is a cardboard box pallet, which is intended for one-time use, i.e. as a disposable pallet. The invention further relates to a module for the transport pallet, a folding sheet for producing the module and a method for producing the transport pallet.

Transport pallets are used for the transport of loading goods of many different types. For this purpose, the transport pallet provides a bearing surface for the loading goods. The transport pallet can be transported using floor conveying equipment such as forklift trucks, together with the loading goods placed thereon, and therefore, for example, be lifted onto the loading area of a heavy goods vehicle. To this end, prongs of the material handling device engage laterally into the base body between the feet of the base body. The feet are then arranged between a top surface of the body, which is the bearing surface for the loading goods, and a lower surface of the base body, which is a contact surface for the respective substrate.

In many cases, the transport pallets used have a base body, which consists substantially of wood, such a transport pallet being known, for example, by the name "Euro-pallet". These known transport pallets are used for several purposes. After each use, these transport pallets, which are also designated as reusable pallets, are therefore returned.

As an alternative to the reusable pallets, for example, disposable pallets are known, the base bodies of which consist substantially of cardboard. Disposable pallets can be useful or even prescribed, in order to counteract the spread of pathogens, which could accumulate on the transport pallets. In addition, the cost-effectiveness of disposable pallets increases compared to reusable pallets with increasing transport distance, since the return transportation of the transport pallet is eliminated. However, for reasons of economic efficiency the disposable pallet must be able to be produced much less expensively than the reusable pallet. At the same time, sufficient stability must also be ensured in the disposable pallet.

In case of one such transport pallet known from U.S. Pat. No. 3,911,834 known, but which is not yet fully produced with sufficient stability, a base body is provided, which consists of a composite with a plurality of identical modules, wherein each of the modules consists of exactly one folded and glued folding sheet formed of a plurality of folding sheets identical to each other, each forming one segment of the surface of the base body.

To produce sufficient stability, in this transport pallet disclosed in U.S. Pat. No. 3,911,834, two end plates are additionally provided, which are produced separately from the folding sheets for the modules from other folding sheets, which enclose the modules and can absorb shear forces. Thereafter, it is no longer the modules but the end plates that provide the surface of ready-to-use transport pallet. The manufacture of the different folding sheets must be performed in separate manufacturing processes, which makes the production and handling during assembly time-consuming and expensive. In addition, for each transport pallet a total of four folding sheets are required that are quite large in relation to the size of the transport pallet, which leads to a high material consumption and makes the transport pallet even more expensive.

The object of the invention therefore is to provide a transport pallet of the above type, which is sufficiently stable and, at the same time, can be cost-effectively produced.

The invention achieves this object with a transport pallet, with a module for the transport pallet, with a folding sheet for producing the module and with a method for producing a transport pallet according to the invention. In a transport pallet having a base body, wherein the base body has a top surface, which is a bearing surface for loading goods, wherein the base body consists of a composite which exclusively has a plurality of modules that are identical to one another and connecting means, by means of which the modules are connected to one another, wherein each module consists of exactly one folding sheet from a plurality of folding sheets that are identical to each other and a fixing means, in particular an adhesive, and in each case provides one segment of the top surface of the base body, wherein the base body has a lower surface which is a contact surface to the respective substrate, and wherein between the upper surface and the lower surface the base body has feet, between which prongs of material handling equipment can laterally engage in the base body, it is provided according to the invention that the base body has exactly four modules of the identical modules, that each module has exactly four feet of the feet of the base body, arranged spaced apart from one another, that each foot has foot lateral surfaces, by means of which each respective foot is laterally closed around a hollow space, and that on each side each module has one lateral surface, which is formed from foot lateral surfaces of two feet of the feet of the module, wherein the foot lateral surfaces that form opposite lateral faces of modules connected to one another rest flat against each other. In accordance with the method, four modules identical to each other are connected to the base body, so that each module subsequently provides one segment of the base body.

The transport pallet is, in particular, a disposable pallet. Preferably, the transport pallet is also a flat pallet. The modules are arranged side by side. The segment of the surface of the base body provided by each module represents only a quarter of the bearing surface for the loading goods on the transport pallet. Each module is able to support the loading goods to be stored on the respective segment of the top surface. Overall, a high degree of stability of the base body and thus of the transport pallet is therefore obtained. Due to the use of modules that are identical to each other, these same modules can also be produced in large quantities at low cost. The cavities are arranged in the feet of the module and thus within the folded and fixed folding sheet. The bearing surface of the transport pallet is preferably closed or at least 98% closed, and therefore has no major openings.

The base body preferably has the dimensions of a known Euro pallet, thus a length of 1200 mm and a width of approximately 800 mm. Each module therefore has a length of around 600 mm and a width of approximately 400 mm. The folding sheet required for the production of a module has a length of less than 1000 mm, in particular of 980 mm, and a width of less than 750 mm, in particular of 735 mm. As an alternative, and also preferred, the base body has the dimensions of a Euro2 pallet. The length of the body in this case is about 1200 mm and the width of the body approximately 1000 mm. The modules therefore have a length of around 600 mm and a width of approximately 500 mm. The folding sheets can therefore be inexpensively transported on a Euro pallet to a shipper of goods. The shipping agent can store the folding sheets in a space-saving manner and requires only a comparatively small-sized machine that produces the modules from the folding sheets.

According to a particularly preferred embodiment, the base body has adhesive tape, by means of which the modules are connected to each other.

Adhesive tape is an inexpensive connecting means, which can also be applied automatically onto the modules with little effort for producing the composite. Using the adhesive tape, gaps between directly adjacent modules are preferably bridged on both the top surface and on the lower surface. In particular, the adhesive tape is arranged exclusively on the top surface and on the lower surface of the base body. The adhesive tape can support tensile loads. By the arrangement of the tape on both the top surface and the lower surface, the modules are therefore held together both in the area of the top surface and in the area of the lower surface. This counteracts any bending of the modules relative to one another.

The adhesive tape has an adhesive side, with which a materially bonded connection is produced at the base body between the adhesive tape and the respective module. According to an advantageous extension of the invention, on its opposite side to the adhesive side the tape has an anti-slip coating, at least in some parts. The adhesive tape preferably has an anti-slip coating on the top surface of the base body. This counteracts any slippage of transport goods that are resting on the adhesive tape. The adhesive tape preferably has an anti-slip coating on the lower surface of the base body. This counteracts any slippage of the transport pallet on the substrate. The anti-slip coating causes an increased contact friction compared with the corresponding side of the adhesive tape without this anti-slip coating. On the side opposite to its adhesive side the adhesive tape is not equipped to produce a materially bonded connection with the loading goods or with the respective substrate.

According to a further advantageous extension of the invention, the base body has at least one clamping device for receiving stretch film. In particular, each module has at least one such clamping device. The clamping device is in particular an opening in a side wall of the base body, hence in a side wall of the module. In particular, the opening is arranged in a foot. Preferably, the opening has at least one slot, into which the stretch film can be stuck. Particularly preferably, the opening is formed as a triangular cutout with at least one slot joined thereto. Alternatively, the opening can be star-shaped, for example, and optionally formed with at least one slot joined thereto. The stretch film can be wound around the transport pallet with the loading goods placed thereon, starting from the device used for receiving the stretch film, and thus fix the goods in position relative to each other and to the transport pallet. The transport pallet itself also benefits from the stretch film due to the stabilizing effect holding the individual modules together by means of the stretch film.

Particularly preferably, the folding sheet of each module has sections that are fixed to one another. In order to fix the sections together, the module consists not only of the folded sheet, but also of a fixing means which fixes sections of the folding sheet to one another and therefore makes the module keep its shape. The fixative is preferably an adhesive. Alternatively or in addition, the fixing means has other means known to the person skilled in the art, such as adhesive tape or a clip, which is designed to fix two layers of the folding sheet to each other.

The folding sheet is particularly preferably made of cardboard, in particular corrugated cardboard. Cardboard is inexpensive to provide and can later be sent for recycling. Corrugated cardboard ensures a high stability of the module.

In accordance with the method therefore, one folding sheet made of cardboard is creased and folded to produce each module. The sections of the folding sheet are then fixed together using adhesive. The module can thus be produced automatically and cost-effectively from just the folded sheet and some adhesive. In addition, the folding sheets can be stored in stacks at the respective premises of the goods shipping agent in a space-saving manner, before they are used to produce the transport pallet as needed.

To produce each folding sheet, preferably one sheet of cardboard is punctured to produce separating lines and then grooved or perforated to form crease lines and folding lines. The folding sheet therefore has continuous punched holes or cuts and is grooved or perforated at the crease lines and folding lines. Preferably, the folding sheet is grooved or perforated on only one side. All creases and folds of the folding sheet are therefore effected during the manufacture of the module in one direction, which greatly facilitates the automatic production. The process of forming the grooves or perforations can be simply carried out automatically in advance. For each module only exactly one folding sheet is required. It is therefore no longer necessary to assemble a plurality of folding sheets together.

Each foot preferably has essentially the shape of a cuboid. Therefore, each foot preferably has exactly four pairs of parallel foot lateral surfaces. For the absorption of shear forces, in a particularly preferred embodiment at least one, or exactly one, foot lateral surface of each foot has two or three layers resting flat on top of one another, of which preferably two or all three layers are glued together.

In an advantageous embodiment, a portion of the outer layer of this foot lateral surface is formed by two folds from opposite sides of the foot lateral surface. In particular if this fold is glued to the layer underneath it, which preferably is also a layer folded over downwards from above or below, a high stability of the foot is obtained. The layers of the foot lateral surface area resting flat on top of one another are, in particular, all formed by folded layers with crease lines on each of three or four sides of the foot lateral surface.

Each module has preferably at least two, preferably exactly two, runners. The runners provide a portion of the lower surface of the base body. At least two feet spaced apart, which are formed between the surface of the base body and the respective runner of the module, are assigned to each runner. The runners ensure a greater stability of the part of the base body provided by the respective module, including between the feet. In accordance with a further extension of the invention, the runners have an anti-slip coating on the lower surface of the base body. Alternatively or in addition to an anti-slip coating of the adhesive tape on the lower surface, the base body is thus secured against unintentional slippage on the substrate. According to an advantageous embodiment the top surface also has an anti-slip coating, to secure the transport goods to be stored thereon against slippage.

Between the spaced apart feet on each side of each module, there is respectively exactly one slot in the base body for one of the prongs of the floor conveyor. This provides an advantageous stability against falling for the module. In addition, the transport pallet can be advantageously picked up using the floor conveyor. The prongs of the floor conveyor, arranged side by side, then engage in adjacent modules of the transport pallet. Each prong also reaches through the part of the base body provided by one module and through or into the part of the base body provided by another module.

The base body therefore has exactly two first passages arranged parallel to each other and exactly two second passages, arranged perpendicular to the first passages and parallel to each other, for prongs of the floor conveyor. In this regard, in particular each module has exactly one first passage and exactly one second passage arranged perpendicular to the first passage, for exactly one prong each of the floor conveyor.

In a particularly preferred embodiment it is provided that each slot of each module is at least partly bounded in the direction of the surface by one fold each, which is connected via folding lines at the edges of the segment of the surface of the base body provided by the respective module to the section of the folding sheet providing this segment of the surface, and rests flat against this section of the folding sheet. This enables loads bearing on the transport pallet to be better directed to the feet or onto the prongs of the floor conveyor.

Preferably, each module has two short sides and two long sides, which are at least 18% longer than the short sides. According to an advantageous embodiment the slots on the long sides of the module are no longer than the slots on the short sides of the module. As a result, the slots on the short sides are large enough to allow a prong of the floor conveyor to be threaded in with little effort. In addition, the slots on the long sides are small enough, to have a positive effect on the stability of the module, due to the appropriately dimensioned feet. Preferably, the slots on the long sides of the module no more than 230 mm long, more preferably a maximum of 220 mm long and particularly preferably a maximum of 210 mm long.

Less preferably, the slots on the short sides of the module are shorter than the slots on the long sides of the module. However, the length of the slots on the short sides must be at least 80% of the length of the slots on the long sides of the module.

According to a preferred embodiment, on exactly one short side exactly two feet are arranged, each having one short foot lateral surface and one long foot lateral surface. The short foot lateral faces form the lateral surface of this short side of the module. Preferably, the difference in length between the long foot lateral surface and the short foot lateral surface is at least 90% of the length difference between the long side of the module and the short side of the module. As a result, an asymmetrical arrangement of the slots on the long sides of the module is obtained. In the case of a Euro2-pallet the length difference between the long side of the module and the short side of the module is only half as large as that of a Euro pallet. In particular, if the transport pallet has the dimensions of a Euro2 pallet, the length difference between the long foot lateral surface and the short foot lateral surface is therefore even at least 180% of the length difference between the long side of the module and the short side of the module.

In the transport pallet assembled from four modules, the short side of the respective module referred to is arranged on the outside. The modules are therefore connected to each other in the area of their respective opposite short sides. This allows the transport pallet to be picked up by the floor conveyor from all sides, without the distance between the prongs having to be changed relative to one another. In addition, the large length of the long foot lateral surface causes as short a length as possible of the adjacent slot on the long side of the module. As a result, the load bearing capacity of the module is only slightly weakened by the slot.

Figure 4:
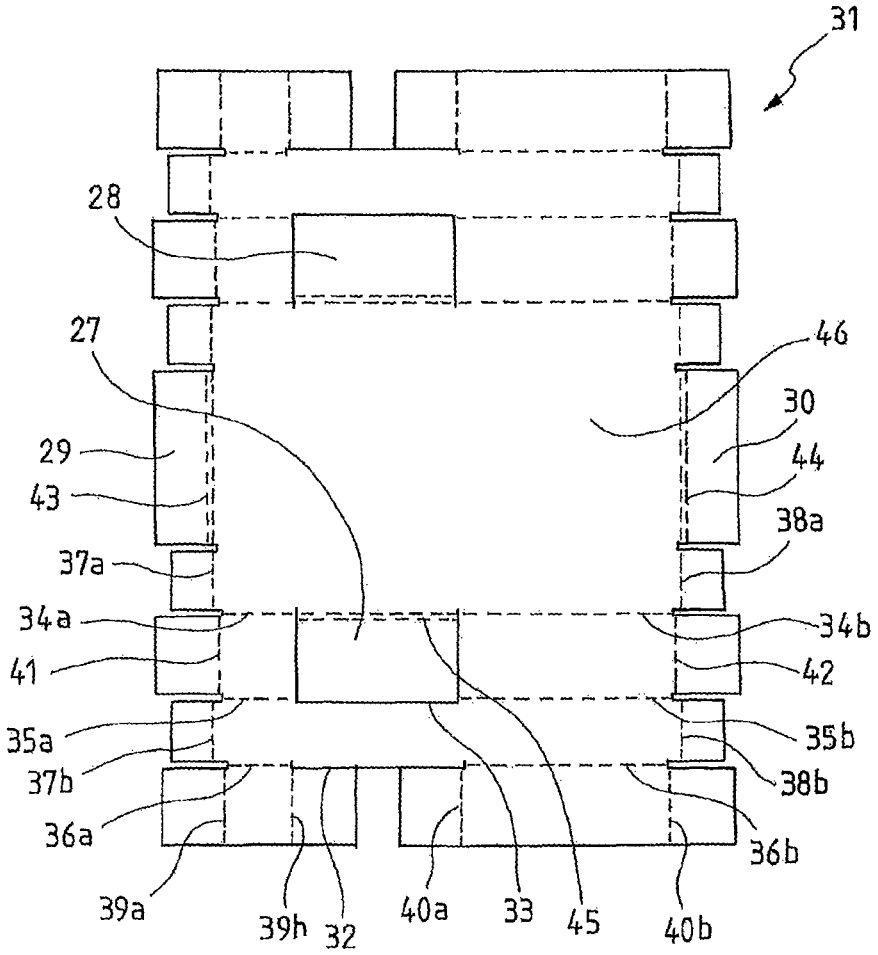
Figure 7:
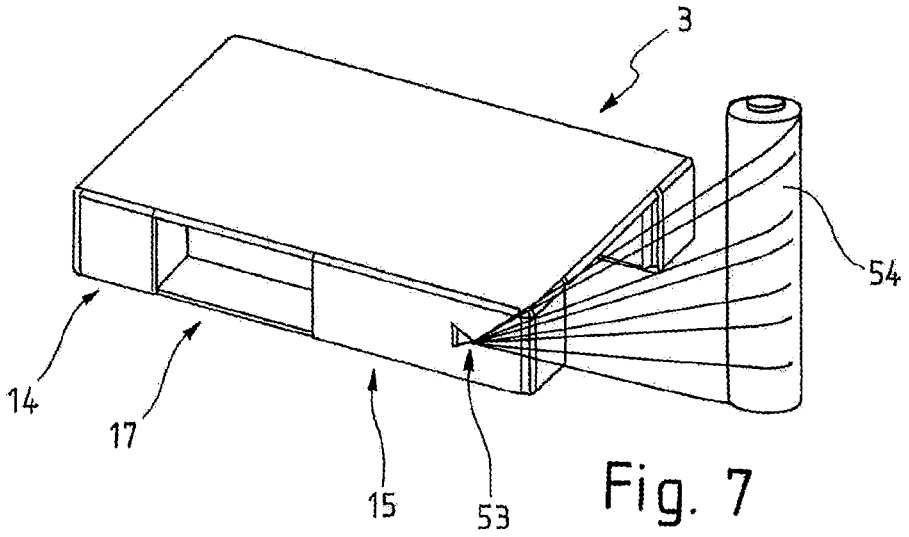
Figure 8:
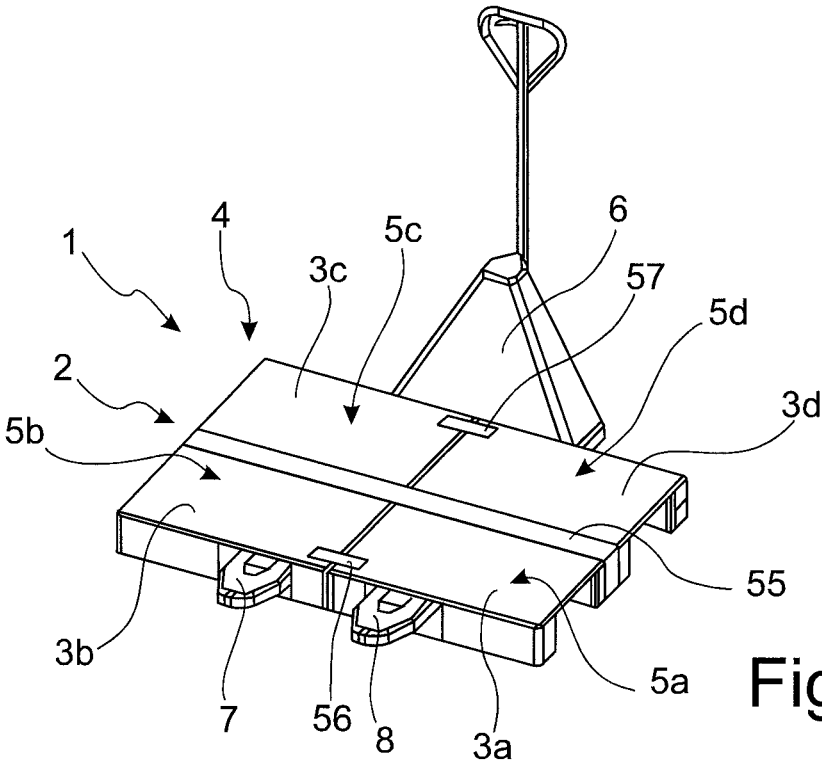
Figure 9:
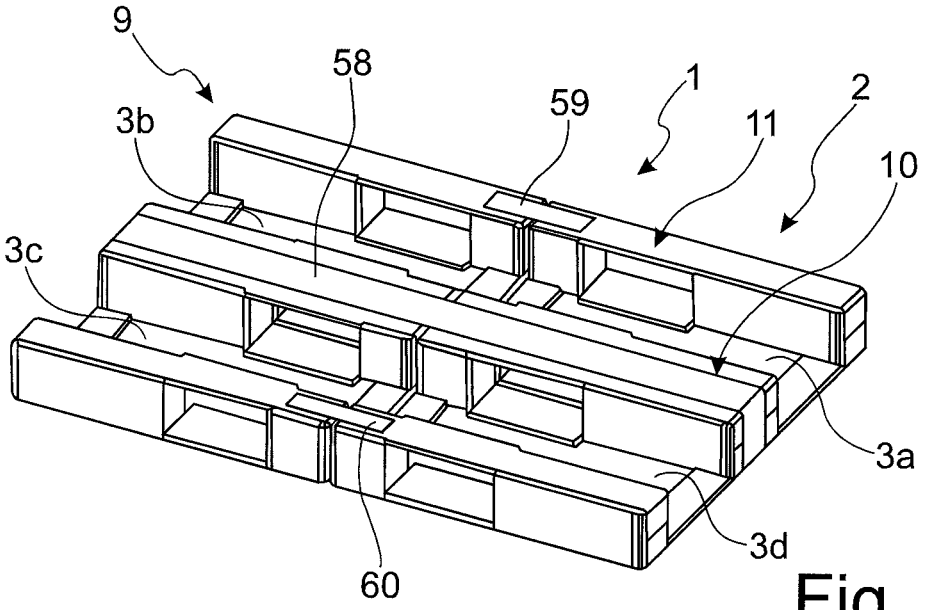

Further embodiments arise from the claims, from the exemplary embodiments of the invention shown in the drawings and from the following description of these exemplary embodiments. The drawings show:

FIG. 1: a transport pallet according to a first exemplary embodiment of the invention together with a floor conveyor in a perspective representation;

FIG. 2: the transport pallet of the first exemplary embodiment in accordance with FIG. 1 in a perspective representation rotated through 180°;

FIG. 3: a module of the transport pallet of the first exemplary embodiment in accordance with FIG. 1 in a perspective representation rotated through 180°;

FIG. 4: a folding sheet for producing the module of FIG. 3 in a plan view;

FIG. 5: the folding sheet of FIG. 4 with bent or folded sections in perspective view;

FIG. 6: the folding sheet of FIGS. 3 and 4 with further bent sections in perspective view;

FIG. 7: a module for a transport pallet according to a second exemplary embodiment of the invention with a clamping device in perspective view;

FIG. 8: the transport pallet according to a first exemplary embodiment of the invention together with a floor conveyer in a perspective representation, in which adhesive tapes connect the modules together to form a composite; and FIG. 9: the transport pallet of the first exemplary embodiment in accordance with FIG. 8 in a perspective representation rotated through 180°.

In FIG. 1 a transport pallet is designated with the reference numeral 1. The transport pallet 1 has a base body 2. In the illustrated exemplary embodiment, the transport pallet 1 consists of the base body 2 alone. In accordance with exemplary embodiments not shown, however, superstructures or attachments can be provided on the base body 2.

The base body 2 has four identically designed and thus identical modules 3*a*, 3*b*, 3*c* and 3*d*, which hereafter are also designated with the reference numeral 3. The base body 2 comprises a top surface 4. In doing so, the module 3*a* provides a segment 5*a*, the module 3*b* a segment 5*b*, the module 3*c* a segment 5*c* and the module 3*d* a segment 5*d* of the top surface 4. The segments 5*a*, 5*b*, 5*c* and 5*d* are hereafter collectively designated with the reference numeral 5.

On the transport pallet 1, loading goods can be stacked and transported with the transport pallet 1. The top surface 4 is therefore a bearing surface for loading goods. For lifting and moving the transport pallet 1 a standard commercially available floor conveyor 6 can be used, for example in the form of the forklift truck illustrated. The floor conveyor 6 has prongs 7 and 8 arranged parallel to each other, which engage in the base body 2 under the top surface 4 and, if necessary, can reach through the base body 2.

Adhesive tapes 55, 56, 57, 58, 59 and 60 are shown in FIGS. 8 and 9, which connect the modules 3*a*, 3*b*, 3*c*, 3*d* together, form a composite. The adhesive tapes 55, 56, 57, 58, 59 and 60 bridge gaps between the modules 3*a*, 3*b*, 3*c*, 3*d* on the top surface 4 and on the lower surface 9 of the base body 2 shown in FIG. 9. The lower surface 9 of the base body 2 is provided by runners 10 and 11, which in FIG. 9 are only labelled by way of example for the module 3*a*. Further details on the modules 3 can be found in the description of FIGS. 3 to 7.

In FIG. 3, one of the modules 3, for example the module 3*a*, of the first exemplary embodiment of FIGS. 1 and 2 is shown separately. Between the segment 5, hidden in the illustration according to FIG. 3, of the top surface 4 to be produced and the first runner 10, a first short foot 12 and a first long foot 13 are arranged. Between this segment 5 and the second runner 11 are a second short foot 14 and a second long foot 15 are arranged. Between the first short foot 12 and the first long foot 13 a first slot 16 is located. Between the second short foot 14 and the second long foot 15 a second slot 17 is located. A third slot 18 is located between the short feet 12 and 14. A fourth slot 19 is located between the long feet 13 and 15. Due to the slots 16, 17, 18 and 19, one of the prongs 7 and 8 of the floor conveyor unit 6 can therefore engage into the module 3, and thus into the main body 2, from a first long side 20, from a second long side 21, from a first short side 22 and from a second short side 23, in accordance with FIGS. 1 and 2.

The module 3 has a multi-part lateral surface on each side 20, 21, 22 and 23. Of these, the lateral surface on the first long side 20 is composed of a first foot lateral surface 24 of the first short foot 12 and of a long foot lateral surface 25 of the first long foot 13. The first long foot 13 has a short foot lateral surface 26 on the second short side 23. The second long foot 15 has foot lateral surfaces with dimensions which correspond to the dimensions of the foot lateral surfaces of the first long foot 13. In the area of the slots 16, 17, 18 and 19, the module 3 has folds 27, 28, 29 and 30 for reinforcement.

FIG. 4 shows a folding sheet 31 made of corrugated cardboard. In its area shown at the bottom, the folding sheet 31 has a first separating line 32 and a second separating line 33. The separating lines 32 and 33 each have three sections that are arranged at right angles to each other. The area of the folding sheet 31 shown at the top is the mirror image of the area shown at the bottom, so that in this case only the area formed at the bottom will be described. The description applies analogously to the region shown at the top.

The separating lines 32 and 33 are produced by punching or by means of a cutting tool. One section of the separating line 32 is at the same time a part of the outer border of the folding sheet 31. The folding sheet 31 has crease lines 34*a*, 34*b*, 35*a*, 35*b*, 36*a*, 36*b*, 37*a*, 37*b*, 38*a*, 38*b*, 39*a*, 39*b*, 40*a*, 40*b*, 41 and 42, at which the folding sheet 31 is grooved or perforated on one side, to enable sections of the folding sheet 31 to be bent approximately at right angles thereto.

The folding sheet 31 has folding lines 43, 44 and 45 in the connecting region of the folds 29, 30 and 27 towards a central section 46 of the folding sheet 31. The reverse of the central section 46 provides the segment 5 of the top surface 4 for the main body 2 in the module 3. The folding lines 43, 44 and 45 resemble two crease lines arranged parallel to each other, at which the folding sheet 31 is grooved or perforated on one side. At individual crease lines the folding sheet 31 would either not be able to be folder over by 180°, or only disadvantageously. Due to the folding lines 43, 44 and 45, an advantageous folding of the folds 29, 30 and 27 by approximately 180° towards the central section 46 is possible.

In FIG. 5, the folds 27 and 28 are shown appropriately folded over. Also, sections of the later first short foot 12 are bent at the crease lines 39*a* and 39*b*, and sections of the later first long foot 13 are bent at the crease lines 40*a* and 40*b*. The term bent sections in the present case always refers to an approximately right-angled arrangement of the sections adjoining each other at the bend line relative to each other.

Subsequently a bend is performed along the crease lines 36*a* and 36*b*, then along the crease lines 35*a* and 35*b* and then along the crease lines 34*a* and 34*b*, so that the partially bent and folded folding sheet 31 has the form shown in FIG. 6. Sections are then bent at the crease lines 41 and 42, and optionally glued to the section bent at the crease line 39*a* or to the section bent at the crease line 40*b* respectively. Over these, sections are finally bent at the crease lines 37*a* and 37*b* or at the crease lines 38*a* and 38*b* and glued to the section which is bent at the crease line 41 or 42. Finally, the folds 29 and 30 are also folded over at the folding line 43 or folding line 44 and glued together with the central section 46. After this stage, the module according to FIG. 3 is produced.

The bending and folding of the folding sheet 31 and the gluing of sections of the folding sheet 31 is preferably performed automatically by machine. For this purpose, the folding sheet 31 is taken from a stack of similar folding sheets and as previously described, bent at the crease lines and folded at the folding lines and also glued in some sections, so that the module 3 is produced. As shown in FIGS 3 and 6, cavities are arranged in the feet 12, 13, 14, and 15 of the module 3 and thus within the folded and fixed folding sheet 31. Four such modules are also glued together either automatically or manually by means of adhesive tape. After this the transport pallet 1 is produced and ready for collection for the transport of loading goods.

FIG. 7 shows the module 3 according to a second exemplary embodiment of the invention. The module 3 in this case is substantially designed according to the above description identically to the first exemplary embodiment, but at least in its second long foot 15 and optionally also in its first long foot 13 it has a clamping device 53 in the form of an opening with a slot joined thereto, for clamping stretch film 54. The stretch film 54 can therefore easily be attached to the pallet 1 and hold together the modules 3 of the pallet and the goods placed thereon.

Optionally, at least one of the foot lateral surfaces 24, 25 and 26 and/or the top surface 4 of the base body 2 can be imprinted, for example, with a company logo or an advertisement. Alternatively or additionally, the transport pallet 1, for example, can have an identification device on one of the foot lateral surfaces 24, 25, or 26, for example, in the form of a barcode, an RFID transponder or a label.

All the above mentioned features referred to in the above description or in the claims can be combined in any permutation with the features of the independent claim. The disclosure of the invention is therefore not limited to the feature combinations described or claimed, rather all meaningful feature combinations are to be considered as disclosed in the context of the invention.

LIST OF REFERENCE NUMERALS

| | |
|---|---|
| 1 | transport pallet |
| 2 | base body |
| 3 (3a, 3b, 3c, 3d) | module |
| 4 | upper surface |
| 5 (5a, 5b, 5c, 5d) | segment |
| 6 | material handling device |
| 7 | prong |
| 8 | prong |
| 9 | lower surface |
| 10 | first runner |
| 11 | second runner |
| 12 | first short foot |
| 13 | first long foot |
| 14 | second short foot |
| 15 | second long foot |
| 16 | first slot |

-continued

| | |
|---|---|
| 17 | second slot |
| 18 | third slot |
| 19 | fourth slot |
| 20 | first long side |
| 21 | second long side |
| 22 | first short side |
| 23 | second short side |
| 24 | first foot lateral surface |
| 25 | long foot lateral surface |
| 26 | short foot lateral surface |
| 27 | fold |
| 28 | fold |
| 29 | fold |
| 30 | fold |
| 31 | folding sheet |
| 32 | first separating line |
| 33 | second separating line |
| 34a, 34b | crease line |
| 35a, 35b | crease line |
| 36a, 36b | crease line |
| 37a, 37b | crease line |
| 38a, 38b | crease line |
| 39a, 39b | crease line |
| 40a, 40b | crease line |
| 41 | crease line |
| 42 | crease line |
| 43 | folding line |
| 44 | folding line |
| 45 | folding line |
| 46 | central section |
| 53 | clamping device |
| 54 | stretch film |

The invention claimed is:

1. A transport pallet having a base body, which is formed with a folding sheet consisting of cardboard and having crease lines and with an adhesive, wherein the base body has a top surface, which is a contact surface for loading goods, wherein the base body has a lower surface which is a contact surface to a respective substrate, wherein between the top surface and the lower surface, the base body has feet, between which prongs of floor conveyors can laterally engage in the base body, wherein from the folding sheet exactly four feet of the base body are formed spaced apart from each other, wherein each foot has exactly four foot lateral surfaces, which are arranged parallel in pairs and by means of which each respective foot is laterally closed around one hollow space, wherein each foot has crease lines arranged perpendicular to the top surface of the base body, by means of which adjacent foot lateral surfaces of the respective foot are connected to each other, and wherein one lateral surface is formed by each two feet of the four feet formed from the folding sheet, wherein the base body consists of a composite, which exclusively has four modules that are identical to each other and connecting means, by means of which the modules are connected to one another, wherein each module is connected to two immediately adjacent modules, wherein each module is formed with exactly one folding sheet, which is identical to the folding sheets with which the other modules are formed, and the adhesive, and in each case provides one segment of the surface of the base body, wherein each module on each side comprises one of the lateral surfaces, which is formed in each case by two feet of the module, and wherein the foot lateral surfaces, which form opposite lateral surfaces of connected modules, rest flat against each other, and that all crease lines of each foot of each module, which are arranged perpendicular to the top surface of the base body from which the module is formed, are oriented parallel to one another in the unfolded folding sheet.

2. The transport pallet according to claim 1, wherein the base body has adhesive tape, by means of which the modules are connected to one another, and that gaps between directly adjacent modules are bridged on both the top surface and on the lower surface with the adhesive tape.

3. The transport pallet according to claim 2, wherein the adhesive tape has an adhesive side and on its opposite side to the adhesive side, the tape has an anti-slip coating, at least in some parts.

4. The transport pallet according to claim 1, wherein the base body has at least one clamping device for receiving stretch film.

5. The transport pallet according to claim 1, wherein the folding sheet of each module has sections that are fixed together.

6. The transport pallet according to claim 1, wherein each module has at least two runners, which provide portions of the lower surface of the base body, and that each runner is assigned at least two feet spaced apart from each other, which are formed between the surface of the base body and the respective runner of the module.

7. The transport pallet according to claim 1, wherein between the feet arranged spaced apart from each other on each side of each module, respectively exactly one slot is located in the base body for one of the prongs of the floor conveyor.

8. The transport pallet according to claim 7, wherein each module has two short sides and two long sides, which are at least 18% longer than the short sides, and that the slots on the long sides of the module are no longer than the slots on the short sides of the module.

9. The transport pallet according to claim 8, wherein on exactly one short side, exactly two feet are arranged, each having one short foot lateral surface and one long foot lateral surface, wherein the short foot lateral faces form the lateral faces on this short side of the module, and that the difference in length between the long foot lateral surface and the short foot lateral surface is at least 90% of the difference in length between the long side of the module and the short side of the module.

10. A module for a transport pallet, wherein with a plurality of these modules a base body of a transport pallet is formed, wherein the base body has a top surface which is a bearing surface for loading goods, wherein the base body has a lower surface which is a contact surface to a respective substrate, and wherein between the top surface and the lower surface the module has exactly four feet spaced apart from each other, between which prongs of floor conveyors can laterally engage in the base body, wherein the module provides one segment of the top surface of the base body, wherein the module is formed with exactly one folding sheet consisting of cardboard and having crease lines and with a fixing means, wherein the four feet are formed from the folding sheet, wherein each foot has exactly four foot lateral surfaces, which are arranged parallel in pairs and by means of which each respective foot is laterally closed around one hollow space, wherein each foot has crease lines arranged perpendicular to the top surface of the base body, by means of which adjacent foot lateral surfaces of the respective foot are connected to each other, wherein the module on each side comprises one lateral surface, which is formed in each case from foot lateral surfaces of two feet of the module, wherein the foot lateral surfaces are designed in such a way that the foot lateral surfaces each forming one lateral surface of the module rest flat against the foot lateral surfaces forming a lateral surface of an identically designed module, if the base body is formed from a composite with said modules in which each module is connected to two immediately adjacent modules, and wherein all crease lines of each foot of the module, which are arranged perpendicular to the top surface of the base body are aligned parallel to one another in the unfolded folding sheet from which the module is formed.

11. A folding sheet made of cardboard for producing the module according to claim 10 for a transport pallet, wherein the folding sheet has crease lines, wherein the composition of the folding sheet is such that exactly four feet spaced apart from each other is formed from the folding sheet, wherein each foot formed from the folding sheet has exactly four foot lateral surfaces, which are arranged parallel in pairs and by means of which each respective foot is laterally closed around one hollow space, and wherein the module is produced with the folding sheet, wherein the produced module is formed with the exactly one folding sheet and a fixing means.

* * * * *